US005711166A

United States Patent [19]

Mehta et al.

[11] Patent Number: 5,711,166

[45] Date of Patent: Jan. 27, 1998

[54] AIR SEPARATION METHOD AND APPARATUS

[75] Inventors: Anish Mehta, Somerset; Sidney Simon Stern, Highland Park, both of N.J.

[73] Assignee: The BOC Group, Inc., New Providence, N.J.

[21] Appl. No.: 787,490

[22] Filed: Jan. 22, 1997

[51] Int. Cl.[6] ..... F25J 3/00

[52] U.S. Cl. ..... 62/650; 62/908

[58] Field of Search ..... 62/650, 651, 908

[56] References Cited

U.S. PATENT DOCUMENTS 4,072,023 2/1978 Springmann ..... 62/650

4,367,082 1/1983 Tomisaka et al. ..... 62/650

4,834,785 5/1989 Ayres ..... 62/650

*Primary Examiner*—Ronald C. Capossel

*Attorney, Agent, or Firm*—David M. Rosenblum; Salvatore P. Pace

[57] ABSTRACT

A method and apparatus of separating air in which the air is rectified wig a single column nitrogen generator which produces a nitrogen stream which is expanded into a refrigerant stream and then taken as a medium pressure product. Oxygen enriched air can be taken as low pressure and medium pressure enriched air products. A stream of oxygen enriched air can be used to regenerate the pre-purification unit and also taken as a wet product.

6 Claims, 1 Drawing Sheet

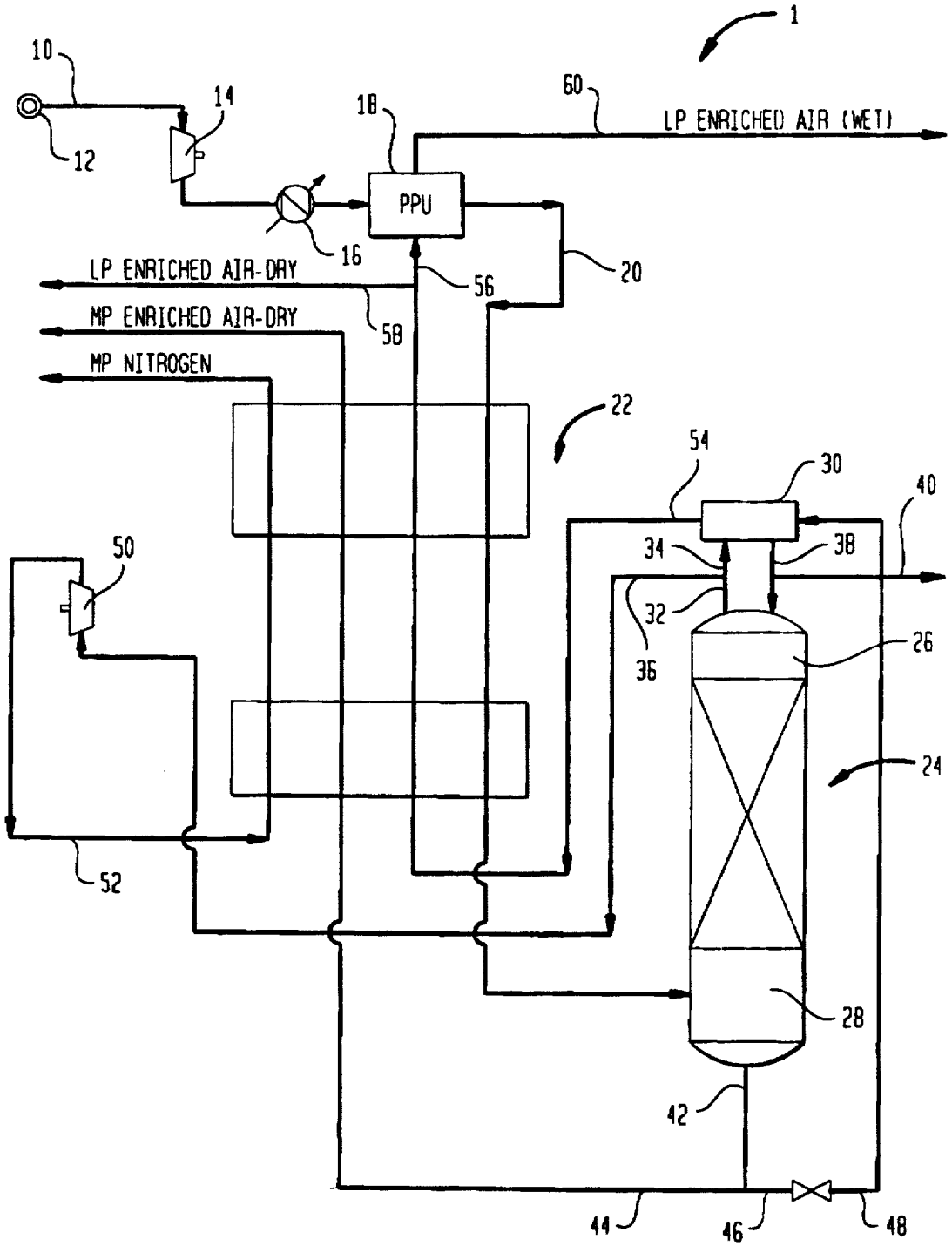
1
10
12
14
16
18
PPU
60
LP ENRICHED AIR (WET)
20
56
LP ENRICHED AIR-DRY
58
MP ENRICHED AIR-DRY
MP NITROGEN
22
54
30
40
34
38
32
36
26
24
50
52
28
42
44
46
48

AIR SEPARATION METHOD AND APPARATUS

BACKGROUND OF THE INVENTION

The present invention relates to a method of separating air wherein the air is separated within a nitrogen generator. More particularly, the present invention relates to such a method wherein a nitrogen stream is expanded to produce a nitrogen product and oxygen enriched air, produced as column bottoms, is warmed to produce an oxygen enriched air product.

When nitrogen is the object of the cryogenic distillation of air, the air, after having been filtered, compressed and purified, is cooled to a temperature suitable for its rectification and then separated within a single distillation column known in the art as a nitrogen generator. The distillation produces a nitrogen tower overhead and a liquid column bottoms which consists of oxygen enriched air. Part of the nitrogen tower overhead is taken as a product and a remaining part of such overhead is condensed and returned to the column as reflux. The oxygen enriched air, after having been valve expanded, is used as a coolant to condense the reflux. The condensation of the reflux vaporizes the oxygen enriched air and part of the resultant vapor can be compressed and recirculated back into the nitrogen generator to increase recovery.

It is necessary that refrigeration be added to the plant in order to heat balance warm end losses and irreversiblities of the air separation process. In U.S. Pat. No. 4,966,002 part of the vaporized oxygen enriched air is turboexpanded to produce a refrigerant stream which is warmed in the main heat exchanger to lower the enthalpy of the incoming air. In this patent, the nitrogen product can be produced at column pressure. U.S. Pat. No. 4,357,153 discloses an oxygen generator (rather than a nitrogen generator) to produce oxygen and nitrogen products. In this patent, the nitrogen product can be expanded, but in such case, it is produced at the low pressure of the turbine exhaust. This pressure is particularly low when it is considered that the expansion of the nitrogen must not only supply refrigeration to the plant, but also, power the recycle compressor for the vaporized oxygen enriched liquid that is to be reintroduced into the nitrogen generator.

As will be discussed, the present invention provides method and apparatus utilizing a nitrogen generator in which the nitrogen, while not being desired at column pressure is, however, required at a pressure obtainable had the nitrogen not be involved in heat pumping the vaporized, oxygen enriched air.

SUMMARY OF THE INVENTION

The present invention relates to a method of separating air in which the air is filtered, compressed and purified to produce a compressed and purified air stream. The compressed and purified air stream is cooled to a temperature suitable for its rectification and the air contained within the compressed and purified air stream is rectified within a single column nitrogen generator. The rectification produces gaseous nitrogen as a tower overhead and oxygen enriched liquid as a column bottoms. A coolant stream composed of the oxygen enriched liquid is valve expanded. Reflux for the nitrogen generator is produced by condensing part of a stream of the gaseous nitrogen against vaporizing the coolant stream. A remaining part of the stream of gaseous nitrogen is partially warmed and then is expanded with the performance of work to produce a refrigerant stream. All of the work of expansion is exported. Heat is indirectly exchanged between the refrigerant stream and the coolant stream with the compressed and purified air stream. As a result, the compressed and purified air stream is cooled to the temperature suitable for its rectification and a refrigerant stream and the coolant stream fully warm. The coolant and refrigerant streams are taken as products.

In another aspect, the present invention relates to an apparatus for separating air. The apparatus comprises a means for producing a compressed and purified air stream. A single column nitrogen generator is provided for rectifying the air contained within the compressed and purified air stream to produce gaseous nitrogen as tower overhead and an oxygen enriched liquid as a column bottoms. A valve is connected to the single column nitrogen generator for valve expanding a coolant stream composed of the oxygen enriched liquid. A head condenser is connected to the nitrogen generator and configured to condense part of a stream of the gaseous nitrogen against vaporizing the coolant stream. The condensation produces reflux for the single column nitrogen generator. An expansion means is provided for expanding a remaining part of the stream of the gaseous nitrogen with the performance of work to produce a refrigerant stream. A means is connected to the expansion means for exporting all of the work of expansion. A main heat exchange means is directly connected to the head condenser to directly receive the coolant stream after the vaporization thereof. The main heat exchange means is also interposed between the expansion means, the single column nitrogen generator and the compressed and purified air stream producing means. The main heat exchange means is configured for cooling the compressed and purified air stream to a temperature suitable for its rectification, for partially warming a remaining part of the stream of the gaseous nitrogen prior to the expansion thereof, and then for fully warming the refrigerant stream and for fully warming the coolant stream.

In the present invention, since the coolant stream is directly taken from the head condenser and then fully warmed, there is no heat pumping. As a result, the work of expansion in case nitrogen product is the work fluid is not being expended in the heat pump cycle. As a consequence, nitrogen product can be withdrawn at a pressure that is greater than that which would otherwise be obtainable (for a given compression of the incoming air) had a heat pump cycle existed.

As used herein and in the claims, the term "fully warmed" means warmed to the temperature of the warm end of main heat exchanger. "Fully cooled" as used herein and the claims means cooled to the a temperature of the cold end of main heat exchanger. The term "partly warmed" as used herein and in the claims means warmed to a temperature between the warm and cold ends of the main heat exchanger complex.

BRIEF DESCRIPTION OF THE DRAWINGS

While the specification concludes with claims distinctly pointing out the subject matter that Applicants regard as their invention, it is believed the invention will be better understood when taken in connection with the accompanying drawings in which the sole figure is an air separation plant for carrying out a method and apparatus in accordance with the present invention.

DETAILED DESCRIPTION

With reference to the figures, apparatus 1 is illustrated for producing the gaseous nitrogen product and several products composed of oxygen enriched air.

Incoming air, as in air stream 10, after after having been filtered by a filter 12, is compressed by a compressor 14. Heat of compression is removed from air stream 10 by an after-cooler 16 and purification thereof is effected within a pre-purification unit 18. Pre-purification unit 18 normally incorporates two or more beds of adsorbent to adsorb impurities such as moisture, carbon dioxide, flammable hydrocarbons. The beds of pre-purification unit 18 are regenerated by desorbing the more preferentially adsorbed components, to wit: the carbon dioxide, water and hydrocarbons, through de-pressurization and purge stages that involve the use of a purge stream.

The resultant air stream 20, which consists of compressed and purified air, is then cooled within a main heat exchanger complex 22 to a temperature suitable for its rectification, normally, at or near the dew point of air. Heat exchanger complex 22 can be a single unit or a collection of units, known in the art. Compressed and purified air stream 20 is then purified within a single column nitrogen generator 24 that produces gaseous nitrogen as a tower overhead in a top region 26 thereof and an oxygen enriched liquid as column bottoms within a bottom region 28 thereof.

A head condenser unit 30 is attached to single column nitrogen generator 24 to condense reflux. A stream 32 of the gaseous nitrogen produced within single column nitrogen generator 24 is extracted from top region 26 thereof. Thereafter, stream 32 is divided so that part forms a reflux stream 34 and a remaining part forms a gaseous nitrogen stream 36. Reflux stream 34 is condensed within head condenser 30 and is returned, as a return stream 38, back to top region 26 of single column nitrogen generator 24. As illustrated, part of return stream 30 can be withdrawn as a liquid nitrogen product stream 40.

Reflux stream 34 is condensed by a coolant which consists of the oxygen enriched liquid. An oxygen enriched liquid stream 42, withdrawn from bottom region 28 of single column nitrogen generator 24, is divided at a junction 43 into two parts. On the of parts of oxygen enriched liquid stream 42 forms a coolant stream 46. Coolant stream 46 is valve expanded in an expansion valve 48 and is then vaporized within head condenser unit 30. The remaining part of oxygen enriched liquid stream 42, namely stream 44, fully warms within main heat exchanger complex 22, thereby vaporizes, and can be taken as a medium presuure oxygen enriched product.

Gaseous nitrogen stream 36 after having been partially warmed within main heat exchanger complex 22 is turboexpanded within an expansion engine 50 to medium pressure. Although not illustrated, expansion engine 50 would be connected to an energy dissipative brake such as a known oil or air brake or an electric generator. The resultant refrigerant stream 52 can be warmed within main heat exchanger complex 22 and then taken as a medium pressure product.

Stream 46 after vaporization becomes a vaporized stream 54. Vaporized stream 54 can be divided into first and second subsidiary streams 56 and 58. Subsidiary stream 56 can be used to regenerate the pre-purification unit 16, or in other words, as a purge stream to produce a low pressure wet enriched product stream 60. The other subsidiary stream 58 can be taken as a low pressure dry enriched product stream 62.

While the invention has been described with reference to a preferred embodiment, as will occur to those skilled in the art, numerous changes, additions and omissions may be made without departing from the spirit and scope of the present invention.

We claim:

1. A method of separating air, said method comprising:

filtering, compressing, and purifying the air to produce a compressed and purified air stream;

cooling the compressed and purified air stream to a temperature suitable for its rectification;

rectifying the air contained within said compressed and pad fled air stream within a single column nitrogen generator to produce gaseous nitrogen as a tower overhead and oxygen enriched liquid as a column bottoms;

valve expanding a coolant stream composed of said oxygen enriched liquid;

producing reflux for said nitrogen generator by condensing part of a stream of said gaseous nitrogen against vaporizing said coolant stream;

partially warming a remaining part of said stream of gaseous nitrogen;

expanding said remaining part of said stream of gaseous nitrogen with the performance of work to produce a refrigerant stream;

indirectly exchanging heat between said refrigerant stream and said coolant stream, directly after vaporization thereof, with said with the compressed and purified air stream so that said compressed and purified air stream is cooled to said temperature suitable for its rectification and said refrigerant stream and said coolant stream fully warm; and taking as products said coolant and said refrigerant streams.

2. The method of claim 1, wherein:

said coolant stream is formed from part of an oxygen enriched liquid stream; and a remaining part of said oxygen enriched liquid stream also exchanges heat with said compressed and purified air stream and thereby vaporizes and fully warms and thereby forms a medium pressure product stream.

3. The method of claim 2, wherein:

said air is purified in adsorbent beds; and said adsorbent beds are regenerated at least in part by part of the coolant stream, thereby forming a wet low pressure product stream from said part of said coolant stream and a dry low pressure product stream from a remaining part of said coolant stream.

4. An apparatus for separating air, said apparatus comprising:

means for producing a compressed and purified air stream;

a single column nitrogen generator for rectifying the air contained within said compressed and purified air stream to produce said gaseous nitrogen as a tower overhead and oxygen enriched liquid as a column bottoms;

a valve connected to said single column nitrogen generator for valve expanding a coolant stream composed of said oxygen enriched liquid;

a head condenser connected to said nitrogen generator and configured to condense part of a stream of the gaseous nitrogen against vaporizing said coolant stream, thereby to produce reflux for said single column nitrogen generator;

expansion means for expanding a remaining part of said stream of gaseous nitrogen with the performance of work to produce a refrigerant stream; and main heat exchange means directly connected to said head condenser to directly receive said coolant stream after the vaporization thereof, interposed between said single column nitrogen generator, said expansion means and said compressed and purified air stream producing means, and configured for cooling the compressed and purified air stream to a temperature suitable for its rectification, for partially warming the remaining part of the stream of the gaseous nitrogen and for fully warming said refrigerant stream and for fully warming said coolant stream.

5. The apparatus of claim 4, wherein:

a junction is connected to a bottom region of said single column nitrogen generator;

said valve is connected to said junction so that said coolant stream is formed from part of an oxygen enriched liquid stream; and said main heat exchange means is also connected to said junction and configured for fully warming a remaining part of said oxygen enriched liquid stream, thereby causing vaporization thereof and a medium pressure product stream.

6. The method of claim 5, wherein said compressed and purified air producing means includes a pre-purification unit having adsorbent beds associated with said main heat exchange means so that said adsorbent beds are regenerated in part by at least part of the coolant stream, thereby forming a wet low pressure product stream from said part of said coolant stream and a dry low pressure product stream from a remaining part of said coolant stream.

* * * * *

UNITED STATES PATENT AND TRADEMARK OFFICE

CERTIFICATE OF CORRECTION

PATENT NO. : 5,711,166
DATED : Jan. 27, 1998
INVENTOR(S) : Mehta et al

It is certified that error appears in the above-identified patent and that said Letters Patent is hereby corrected as shown below:

Cover Page [57] in the ABSTRACT:

Column 2, line 2, delete "wig" and insert -- within -- .

Signed and Sealed this

Fourteenth Day of April, 1998

Bruce Lehman

*Attest:*

BRUCE LEHMAN

*Attesting Officer*

*Commissioner of Patents and Trademarks*